United States Patent [19]

Nakano et al.

[11] Patent Number: 4,698,958

[45] Date of Patent: Oct. 13, 1987

[54] RING FOR SPINNING AND TWISTING MACHINES

[75] Inventors: Yuzuru Nakano, Takarazuka; Takeshi Yoshikawa, Kobe, both of Japan

[73] Assignee: Kanai Juyo Kogyo Co., Ltd., Hyogo, Japan

[21] Appl. No.: 848,380

[22] PCT Filed: Sep. 26, 1985

[86] PCT No.: PCT/JP85/00531

§ 371 Date: Mar. 17, 1986

§ 102(e) Date: Mar. 17, 1986

[87] PCT Pub. No.: WO86/02113

PCT Pub. Date: Apr. 10, 1986

[30] Foreign Application Priority Data

Sep. 27, 1984 [JP] Japan ..... 59-146976

[51] Int. Cl.[4] ..... D01H 7/60

[52] U.S. Cl. ..... 57/119

[58] Field of Search ..... 57/119, 120

[56] References Cited

U.S. PATENT DOCUMENTS

| | | | |
|---|---|---|---|
| 273,090 | 2/1883 | Husband | 57/119 |
| 1,595,858 | 8/1926 | Crompton | 57/119 |
| 2,194,930 | 3/1940 | Feen | 57/119 |
| 2,798,357 | 7/1957 | Stahli | 57/119 |
| 3,118,272 | 1/1964 | Clapp | 57/120 |
| 3,343,362 | 9/1967 | Lunsford | 57/119 |

*Primary Examiner*—Donald Watkins

*Attorney, Agent, or Firm*—Wenderoth, Lind & Ponack

[57] ABSTRACT

A ring for spinning comprising a flange portion, a neck portion and a trunk portion having a ring rail fitting-in part for use on ring spinning machines, twisting machines, etc. At least that portion of the ring which will contact a traveller is formed of ceramics, or the surface of said portion is formed of a ceramic coated layer, to attain high strength of the surface, smoothness in the surface, improved abrasion resistance, improved heat resistance, improved corrosion resistance and high spindle speed of more than 20,000 r.p.m.

7 Claims, 16 Drawing Figures

RING FOR SPINNING AND TWISTING MACHINES

BACKGROUND OF THE INVENTION

1. Field of the Invention

This invention relates to wear resistant, heat resistant and corrosion resistant rings for use on spinning machinery, including ring spinning machines and twisting machines, which are used at a high speed.

2. Description of the Prior Art

Conventionally, rings for spinning machinery are made of carbon steel and subjected to a heat treatment by carburizing and quenching to attain a surface hardness of 800–900 Hv and a hardened depth of 0.4–0.5 mm. However, the useful life of rings for spinning machinery subjected to only the above heat-treatment has been 3–4 years in the cotton spinning field and 1–2 years in the man-made fiber spinning field, at the longest. The shorter service life of such rings made of carbon steel may be attributed to the fact that the ring temperature becomes high and the surface hardness becomes lower due to frictional heat which is generated when a traveller slides on a ring flange, with the result that sliding abrasion due to operations of the traveller increases. Also, conventional rings corrode easily, with the result of earlier exfoliation and abrasion and frequent yarn breakage in the spinning process.

With the object of eliminating the above demerits, some of the conventional rings for spinning machinery are made of alloy steel containing Al, Cr, etc. and are subjected to a hardening treatment, so as to improve hardness of the traveller moving over the surface of the ring and abrasion resistance. However, rings of spinning machinery of this kind have bad affinity to the traveller and therefore travellers do not run smoothly and running-in of travellers for many hours is required to obtain the stabilized spinning condition. Also, due to low toughness of the hardened layer, useful life of the rings is comparatively short.

Since conventional rings for spinning made of carbon steel or alloy steel show high abrasion resistance during sliding of the traveller, these rings involve increased spinning tension and frequent yarn breakage in the spinning process. Therefore, conventional rings are not suitable for high speed operation and a spindle speed of around 16,000 r.p.m. is the maximum for them.

An object of the present invention is to provide rings for spinning machinery which solve the above problems, namely, rings having high surface hardness, a smooth surface, improved abrasion resistance, improved heat resistance and improved corrosion resistance suitable for the high speed spinning operation, high productivity, a longer service life and spinnability of high quality yarn.

SUMMARY OF THE INVENTION

According to the present invention, in a ring for spinning and twisting machines comprising a flange portion, a neck portion and a trunk portion having a ring rail fitting-in part, at least that portion of the ring which makes contact with a traveller i.e. the flange portion, is made of fine ceramic particles (new ceramics) having a grain size of less than 10 μm after sintering, or the surface of the flange portion is made of an electroless coated hard compound layer, e.g. a matrix of nickel-phosphorus alloy in which fine ceramic particles exist as eutectoid substances. The fine ceramics can be $Al_2O_3$, $ZrO_2$, SiC, $Si_3N_4$ or the like, and should be less than 3 μm in grain size before sintering and less than 10 μm in grain size after sintering. The ring should be less than 5 μm R max in surface coarseness. A ring with such a flange portion has a high surface hardness, a smooth surface, and improved wear resistance, heat resistance and corrosion resistance. The ring is suitable for high speed running at more than 20,000 r.p.m., is free from sparking at high speed running, is free from abrasive wear due to the action of ceramics such as a grindstone, permits smooth sliding of a traveller, and provides low spinning tension, less yarn breakage, less yarn fuzzing and longer service life.

BRIEF DESCRIPTION OF THE DRAWINGS

The nature and advantage of the present invention will be understood more clearly from the following description made with reference to the accompanying drawings, in which:

FIG. 4 and FIG. 5 show the comparison between the ring in Embodiment 2 and the conventional ring, in which FIG. 4 is a curve of the hardness distribution and FIG. 5 is a curve of decrease in the quantity by wear;

FIG. 7 and FIG. 8 show the comparison between the ring of Embodiment 3 and the conventional ring, in which FIG. 7 is a hardness distribution curve and FIG. 8 is a curve of decrease in the quantity by wear;

FIG. 9 and FIG. 10 show a ring for spinning in Embodiment 4 of the present invention, in which FIG. 9 is a cross sectional view of the ring and FIG. 10 is a cross sectional view of a main part of the ring, on an enlarged scale;

DETAILED DESCRIPTION OF THE PRESENT INVENTION

A description is made of a preferred embodiment of the present invention, with reference to the accompanying drawings.

Figure 1:
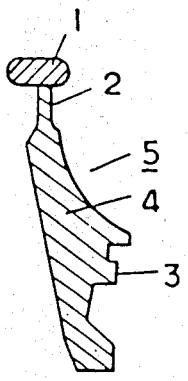
FIG. 1 is a cross sectional view of a ring for spinning showing Embodiment 1 of the present invention.

FIG. 1 illustrates a preferred spinning rings according to the present invention. This ring comprises a flange portion 1, a neck portion 2 and a trunk portion 4 with a ring rail fitting-in part 3. At least the portion of the ring which makes contact with a traveller, namely, the flange portion 1 of the ring, is made in the desired flange shape by casting, using material grain selected from fine ceramics of oxide, carbide, nitride, boride or other group, for example, SiC, $Si_3N_4$, $Al_2O_3$, $ZrO_2$, TiC, TiN, etc. having a grain size of less than 3 μm. The ceramic flange thus obtained is subjected to firing at a high temperature to form a flange of fine ceramics with a hardness of 1,000–3,500 Hv and a grain size, after grain growth, of less than 10 μm. The neck portion 2 and the trunk portion 4 having the ring rail fitting-in part 3 are made of carbon steel, steel alloy, light metal or high polymer material in the desired shape by mechanical processing or by molding. A smooth surface finish is imparted to the surface of the above fine ceramic flange by physical or mechanical surface finish, such as barrel grinding, lapping, polishing, etc. so that the surface coarseness is less than 5 μm R max, preferably, less than 1 μm R max.

If the grain size of the grown grains and the surface coarseness of ceramics composing the flange portion of the ring exceed 10 μm and 5 μm R max respectively, abrasive wear develops while a traveller is sliding in contact with the ring and causes sparks, with the result of shorter life of the travellers.

Use of fine ceramics is not limited to the flange portion but the ring may be made of ceramics in its entirety.

Figure 3B:
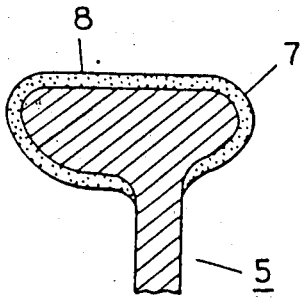
FIG. 3 illustrates a ring for spinning in Embodiment 2 according to the present invention, in which (A) is a cross sectional view of the ring and (B) is a cross sectional view of a main part of the ring, on an enlarged scale.
Figure 3A:
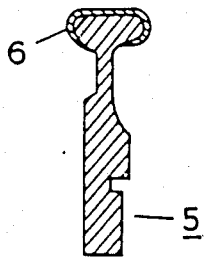

FIG. 3A and FIG. 3B illustrate a spinning ring 5 having a ceramic coated layer at its flange portion. This ring 5 is made of carbon steel, steel alloy, light metal, plastics, compound material or the like. In the case of the ring 5 shown in FIG. 3A, a ceramic coated layer 6 containing the above fine ceramics is formed at the surface of the part of the ring where it makes contact with a traveller, by a coating method, such as CVD (chemical vapor deposition method) including plasma spraying and optical CVD, PVD (physical vapor deposition method) including vacuum deposition spattering or ion plating, IVD (ion vapor deposition method). In the case of FIG. 3B, a ceramic coated layer 8 is formed by electroless plating, uniformly dispersing the ceramic grains, using fine ceramic grains 7 as eutectoid substance and a nickel phosphorus alloy as matrix.

The above ceramic coated layer can be applied to the whole surface of a ring but it is sufficient to apply it only to that part of the surface which makes contact with a traveller, for which a masking treatment is given to that surface before coating.

Fine ceramic grains to be used for the present invention singly or in combination are $Al_2O_3$, $ZrO_2$, $SiO_2$, $TiO_2$, $In_2O_3$, ZaO, $Cr_2O_3$, SiO, TiO, MgO, BeO, $ThO_2$, etc. as oxide group, SiC, TiC, TaC, ZrC, WC, HfC, $B_4C$, NbC, C (diamond), etc. as carbide group, $Si_3N_4$, TiN, TiC, N, TaN, ZrN, AlN, GaN, BN, InN, etc. as nitride group, and $TiB_2$, $ZrB_2$, $HfB_2$, etc. as boride group.

A detailed description of the present invention is made below with reference to several embodiments.

Embodiment 1

FIG. 1 is a cross sectional view of a main part of a ring for spinning which shows Embodiment 1 of the present invention. A flange portion 1 of this ring was molded in the desired shape by casting, using silicon carbide (SiC) whose average grain size is less than 1 μm. It was subjected to firing at around 1,800° C. and further to a surface treatment by barrel grinding to form a flange portion of ceramics with a hardness of 2,000 Hv, grain size of 10 μm or less for the grown grains, and surface coarseness of 0.5–1.0 μm R max.

A neck portion 2 and a trunk portion 4 having a ring rail fitting-in part 3 were made by mechanical processing, using carbon steel as material. The flange portion 1 and the other portions were bonded together into one body by soldering or with an adhesive, such as epoxy, cyanoacrylate, etc. to compose a ring for spinning according to the present invention. The ring thus obtained was tested for wear by a wear testing machine under the following conditions.

Testing conditions:

| | |
|---|---|
| Ring | 45 mm |
| Traveller | OS No. 2 |
| Spindle speed | 7,000 r.p.m. |

Figure 2:
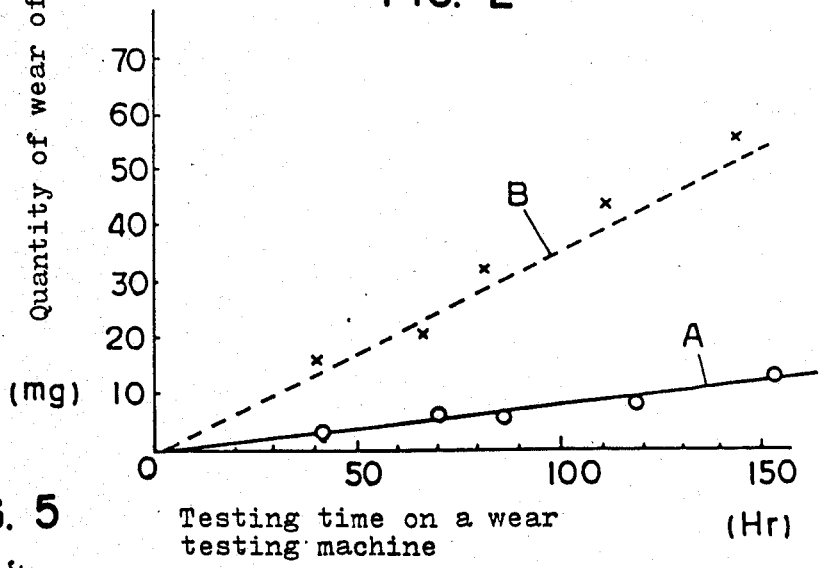
FIG. 2 is a graphical representation of the comparison between the ring of Embodiment 1 and the conventional ring in the quantity of wear.

Regarding the quantity of wear, the result of comparison with the conventional ring B made of carbon steel was as shown in FIG. 2.

As is obvious from FIG. 2, the ring A according to the present invention shows a gradual increase in the quantity of wear with the lapse of time, at a much smaller degree than the conventional ring B.

From the above test results, it can be seen that the flange portion made of silicon carbide (SiC) has high strength, high heat resistance and high abrasion resistance. Moreover, since the flange portion made of silicon carbide has almost the same heat conductivity as the metallic traveller, it easily to radiates heat generated by sliding of the traveller and therefore contributes to reduction of burning and wearing of travellers and consequent longer service life of the travellers.

Embodiment 2

FIG. 3 is a cross sectional view of a ring for spinning which shows Embodiment 2 of the present invention. It is a horizontal type single flange ring made of low carbon steel or steel alloy by a cutting process.

Figure 4:
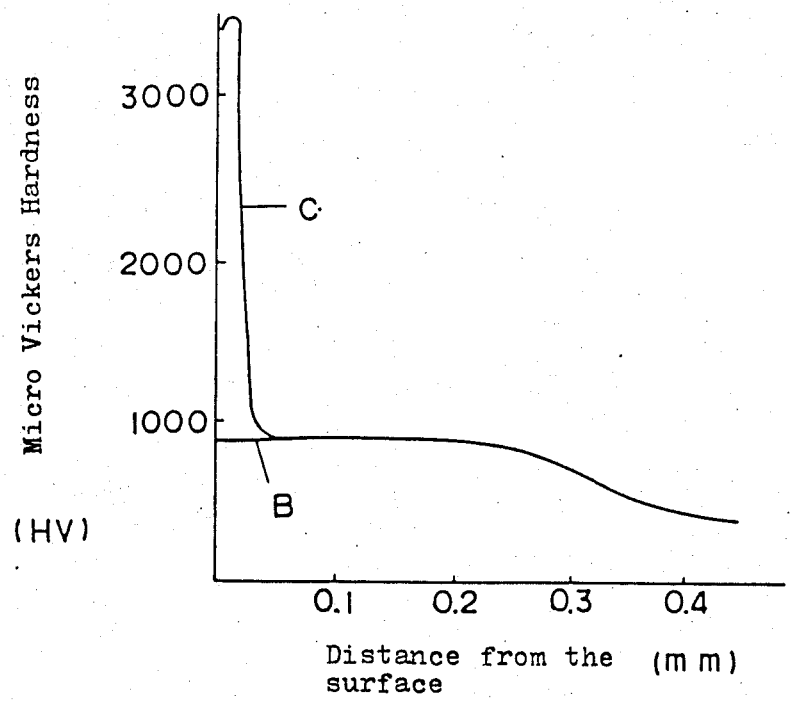

After the ring was carburized, it was subjected to an ion plating treatment by glow discharge at $1-5\times10^{-2}$ Torr in a reactive gas atmosphere with $C_2H_2$ as a main ingredient to form a ceramic coated layer 6 of 1–20 μm thickness having titanium carbide (TiC) at the surface which makes contact with a traveller. Then, it was further subjected to a heat treatment and a lapping treatment to attain a grown grain size of less than 10 μm at the ceramic coated layer, and a surface roughness of less than 1 μm R max. The ring C thus obtained has a hardness of 2,500–3,400 Hv which is much higher than that of the conventional ring B which was carburized and quenched, as shown by the FIG. 4 curves of cross sectional hardness distribution.

Figure 5:
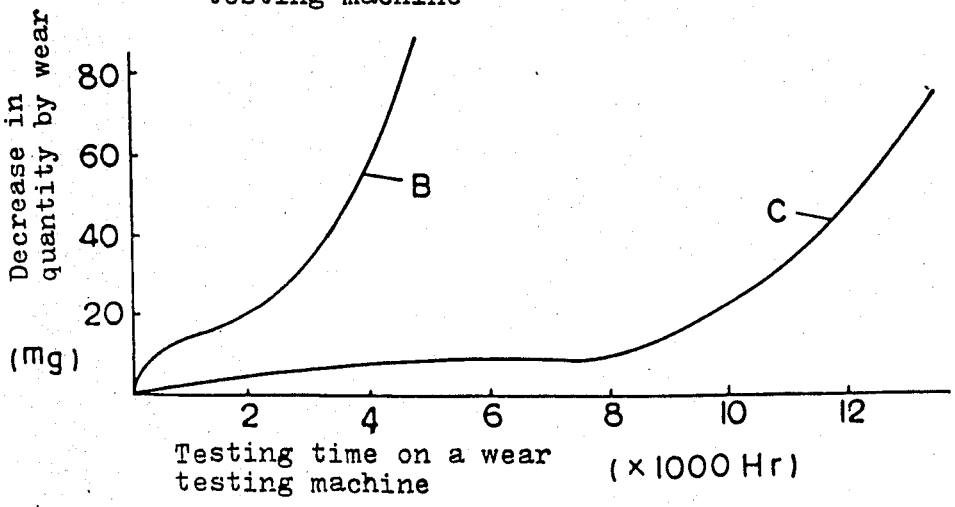

FIG. 5 shows curves of running time and the quantity of wear in the case where spinning was carried out under the following testing conditions, using the ring C for spinning according to the present invention.

Testing conditions:

| | |
|---|---|
| Inside diameter of ring: | 41 mmØ |
| Width of flange: | 3.2 mm |
| Fiber: | Combed cotton yarn $40^{/s}$ |
| Spindle speed: | 27,000 r.p.m. |
| Traveller: | YS-2/hf 14/c (spiv type traveller) |
| Number of twist: | 22T/in |

From FIG. 5, it can be seen that as compared with the conventional ring B for spinning, the ring C for spinning according to the present invention has about one-fifth the wear and more than 5 times the service life of the conventional ring. In spinning at a spindle speed of more than 20,000 r.p.m., the conventional ring B results in an increase in spinning tension due to the increase in frictional resistance between the ring and the traveller, which causes yarn breakage, "fly" of traveller and other troubles and makes it difficult to carry out continuous running. On the contrary, the ring according to the present invention shows a lower coefficient of friction, requires no running-in and is applicable to high speed running from the start.

Embodiment 3

Figure 6:
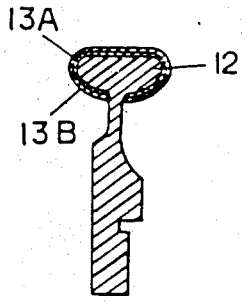
FIG. 6 is a cross sectional view showing Embodiment 3 of the present invention.

FIG. 6 is a cross sectional view of the ring for spinning showing Embodiment 3 of the present invention. A single flange ring 12 shown by FIG. 6 was made of low carbon steel by a cutting process.

After the above ring was subjected to a carburizing treatment and a surface grinding treatment, it was subjected to a CVD treatment at a temperature of 850°–1,050° C. in a gas atmosphere with $TiCl_4$, $H_2$, $CH_4$, $N_2$ as main ingredients to form a ceramic coated layer 13A of 2–20 μm thickness containing titanium carbide (TiC) and a ceramic coated layer 13B of 1 μm thickness containing titanium nitride (TiN) at the surface which makes contact with the traveller. The ring was then subjected to quenching and surface grinding.

The above TiC and TiN ceramic coated layer can be applied to the whole surface of a ring but it is sufficient to apply it only to the surface which makes contact with a traveller, for which a masking treatment is given to that surface before coating.

Figure 7:
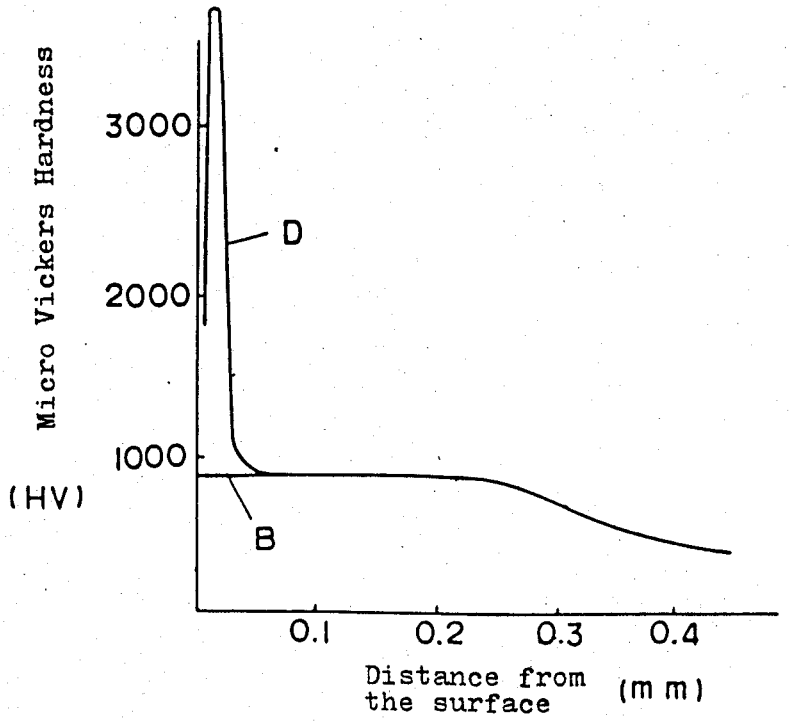

The ring D for spinning obtained in the above way shows an uppermost surface hardness of 1,900–2,500 Hv and an hardness of 3,300–3,600 Hv at the depth of 1 μm, as shown by FIG. 7.

Figure 8:
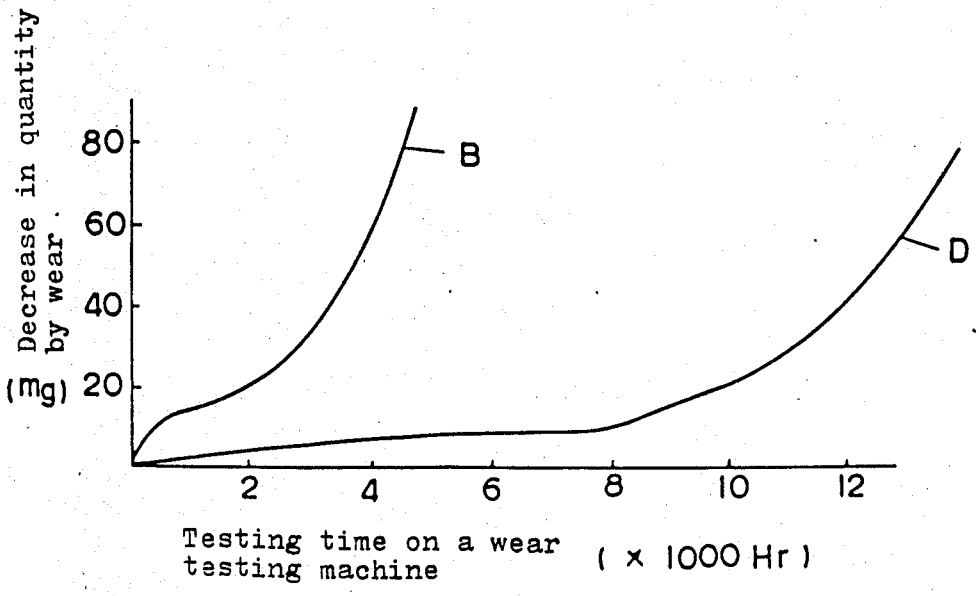

FIG. 8 shows curves of the running time and the decrease in quantity by wear in the case where spinning was carried out under the following testing conditions, using the ring D for spinning according to the present invention.

| | |
|---|---|
| Inside dia. of ring: | 41 mm |
| Width of flange: | 3.2 mm |
| Fiber: | Rayon Bright 20's |
| Spindle speed: | 20,000 r.p.m. |
| Traveller: | ZSC/hf 8/0 (spiv type) |

It can be seen from FIG. 8 that as compared with conventional ring B for spinning, the ring D for spinning according to the present invention shows about one-fifth the wear and more than 5 times the service life of the conventional ring.

Embodiment 4

Figure 9:
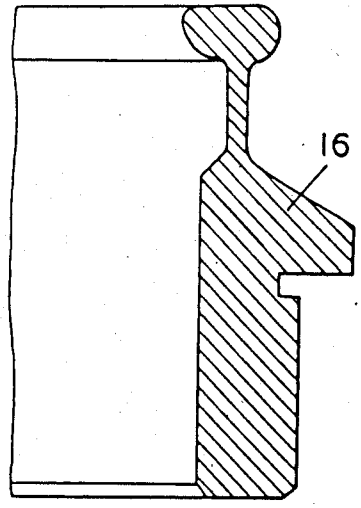
Figure 10:
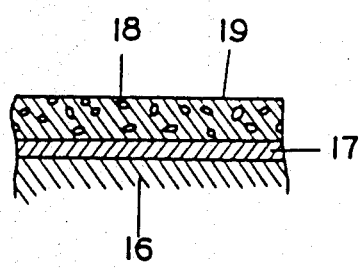

FIG. 9 is a cross sectional view of a ring for spinning in Embodiment 4 of the present invention. This ring was made of carbon steel, for example, S15CK material, and was formed into a single flange 16 by a cutting process. It was subjected to carburizing, quenching and surface treatment. A nickel plated film 17 of about 1 μm thickness was formed at the surface of ring by electroless plating, as shown in FIG. 10.

A ring with the above nickel plated film 17 was soaked in a plating bath of the following composition controlled to a bath temperature of 90° C. and pH 4.5 and non-elecrolytic plating was carried out, while adding 2 g/liter of silicon carbide as hard fine grains having a grain size of 0.4 μm, stirring the bath and turning or oscillating the ring. The bath composition was

| | |
|---|---|
| Nickel sulfate: | 24 g/liter |
| Sodium hypophosphate: | 21 g/liter |
| Lactic acid: | 30 g/liter |
| Propionic acid: | 2 ml/liter |
| Lead nitrate: | 0.0001 g/liter |

Figure 11:
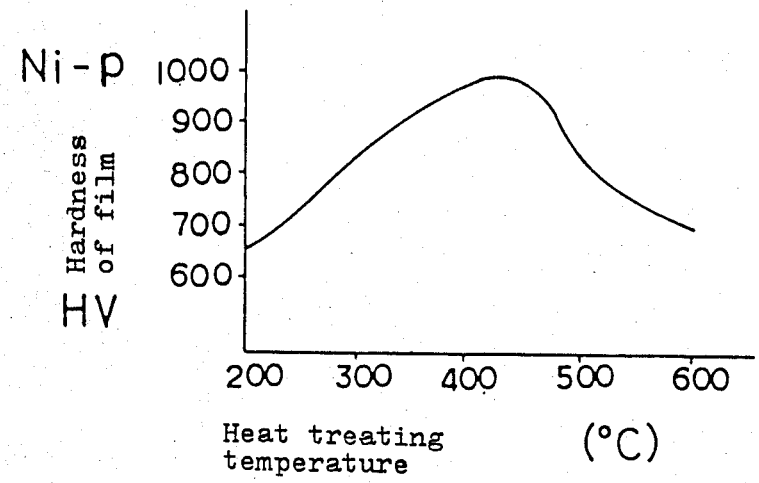
FIG. 11 is a hardness distribution curve of the ring of Embodiment 4.

By the above treatment, a hard composite coating layer 19 of nickel-phosphorus alloy as matrix in which silicon carbide 18 is precipitated, was formed on the surface of the nickel plated film 17 was formed. Then, the ring was heated for about one hour at about 400° C. in a heat treating furnace, whereby the electroless plated nickel plated film was imparted with a hardness of 1,000 Hv due to crystallization of nickel-phosphorus, as shown by FIG. 11. The crystallization of nickel-phosphorus strengthened the cohesiveness of silicon carbide.

Figures 12A, 12B:
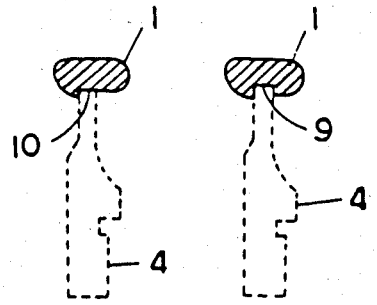
FIG. 12A and FIG. 12B are respectively a cross sectional view of a flange portion of a different embodiment of the present invention.
Figure 14:
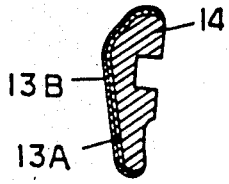
FIG. 14 is a cross sectional view of the ring of Embodiment 3 of the present invention which was applied to a conical type sintered ring.
Figure 13:
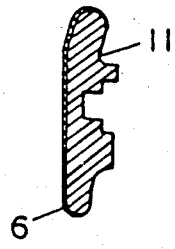
FIG. 13 is a cross sectional view of the ring of Embodiment 2 of the present invention which was applied to a vertical type sintered ring.

FIG. 12, FIG. 13 and FIG. 14 show cross sectional views of rings for spinning of different embodiments of the present invention.

FIG. 12 is a modification of the ring in Embodiment 1, in which a concave part 9 (FIG. 12A) or a shoulder part 10 (FIG. 12B) is made at the underface of the flange portion 1, and the flange portion and the neck portion are fitted together into a ring for spinning. In this case, joining and fixing of both portions are more accurate.

FIG. 13 is a modification of the ring in Embodiment 2. It is a vertical type sintered ring 11 with a ceramic coated layer 6 at the upper surface, the inner trunk surface and undersurface. FIG. 14 is a modification of the ring in Embodiment 3. It is a conical type sintered ring 14 with a ceramic coated layer 13A containing titanium carbide and another ceramic coated layer 13B containing titanium nitride at the upper surface, the inner trunk surface and undersurface.

In the above sintered rings, since they have a single layer of plural layers of ceramic coating on the surface of pores of the surface layer portion, they are much improved in abrasion resistance.

An explanation is made below about the action produced when the ring for spinning according to the present invention was fitted to a ring spinning machine.

A sliver of yarn is fed from a drafting device, passes through a snail wire, is fed on a ring spinning machine where it is given twist by the turning of a traveller fitted in the ring for spinning according to the present invention and is wound around a bobbin.

In spinning at a spindle speed of 20,000 r.p.m. or higher, the conventional ring made of carbon steel or alloy steel produces an increase in frictional resistance and an abnormally high spinning tension, causing yarn breakage and "fly" of the traveller and making it impossible to spin yarn. In the present invention, however, since the surface of flange is so made that the grown grain size of the ceramic is less than 10 μm and the surface coarseness is less than 5 μm R max, preferably less than 1 μm R max, the ring according to the present invention requires no running-in at the start, is applicable to high speed running, makes it possible to carry out continuous operation stably even at a spindle speed of more than 25,000 r.p.m., is improved in heat resistance and heat radiatability, and is free from burning of travellers.

Since the ring according to the present invention has a high surface hardness and a smooth surface, it is applicable safely to high speed running of a ring spinning machine, twisting machine, etc. in spinning and twisting processes and is most suitable for high production.

What is claimed is:

1. In a ring for a spinning or twisting machine comprising a flange portion, a neck portion and a trunk portion having a ring rail fitting-in part, the improvement wherein at least that part of the flange portion which is to contact a traveller (1) consists essentially of fine ceramics which prior to sintering have a grain size of less than 3 μm and after sintering have a grain size of less than 10 μm, and (2) has a surface coarseness of less than 5 μm R max.

2. The ring as defined in claim 1, wherein the entire flange portion is made of said fine ceramics.

3. The ring as defined in claim 1, wherein the traveller-contacting part of the flange portion is made of said fine ceramics, and is formed by a chemical vapor deposition method or a physical vapor deposition method.

4. The ring as defined in claim 1, wherein said fine ceramics are selected from the group consisting of $Al_2O_3$, $ZrO_2$, SiC and $Si_3N_4$.

5. The ring as defined in claim 1, wherein the flange portion has a concave section or shoulder section at its undersurface for fixed engagement with the neck portion.

6. In a ring for a spinning or twisting machine comprising a flange portion, a neck portion and a trunk portion having a ring rail fitting-in part, the improvement wherein at least a part of the surface of the flange is coated with a layer of nickel, and an electroless-coated layer of a nickel-phosphorus alloy as matrix in which fine ceramic particles having a grain size of less than 10 μm exist as eutectoid substance, is formed on said nickel layer.

7. The ring as defined in claim 6, wherein said fine ceramic particles are selected from the group consisting of $Al_2O_3$, $ZrO_2$, SiC and $Si_3N_4$.

* * * * *